US007977287B1

(12) United States Patent
Hicks et al.

(10) Patent No.: US 7,977,287 B1
(45) Date of Patent: Jul. 12, 2011

(54) MICROEMULSION (NANOTECHNOLOGY) ADDITIVE TO OIL

(75) Inventors: Richard H. Hicks, Railroad Flat, CA (US); Ben C. Song, Palo Alto, CA (US)

(73) Assignee: H2Oil Corporation, Hayward, CA (US)

( * ) Notice: Subject to any disclaimer, the term of this patent is extended or adjusted under 35 U.S.C. 154(b) by 113 days.

(21) Appl. No.: 12/386,364

(22) Filed: Apr. 17, 2009

(51) Int. Cl.
*C10M 107/34* (2006.01)

(52) U.S. Cl. ..... 508/579; 508/583

(58) Field of Classification Search ..... 508/577, 508/579, 583
See application file for complete search history.

(56) References Cited

U.S. PATENT DOCUMENTS 6,403,541 B1 * 6/2002 Kambara et al. ..... 508/579

* cited by examiner

*Primary Examiner* — Cephia D Toomer
(74) *Attorney, Agent, or Firm* — William S. Bernheim

(57) ABSTRACT

A micro-emulsion forming (nanotechnology) oil additive composition is disclosed which improves the fuel economy and reduces the exhaust emissions of internal combustion machines when used at a cost effective dose level of about 20:1 to 2,000:1 in the crankcase lubricating oil.

2 Claims, No Drawings

MICROEMULSION (NANOTECHNOLOGY) ADDITIVE TO OIL

BACKGROUND

1. Field of the Invention

There exists a large body of prior art patents all concerned with fuel/water emulsions being used to improve the combustion of liquid hydrocarbon fuels. Almost exclusively, these distinguish amongst themselves by patentable differences between the surfactants and co-surfactants used to create these emulsions.

It is well known that water can be used to improve the combustion of liquid hydrocarbon fuels used in internal combustion machines. Water being introduced into the combustion chamber either together with the fuel in the form of an emulsion (most common) or by injection into the combustion air stream (least common).

However, there is another pathway for water to enter the combustion chamber. Water can enter as an emulsion within the extremely small amount of engine crankcase lubricating oil which is always burned in all typical internal combustion machines.

2. Description of the Prior Art

Water and lighter hydrocarbon fuels (gasoline and diesel) do not stay mixed long enough for combustion purposes and several strategies have been employed to achieve sufficient emulsion stability. U.S. Pat. No. 6,607,566 Coleman teaches using a small quantity of emulsifying agent and significant mechanical agitation to create fuel macro-emulsions (having water droplets greater than 1.0 microns diameter). U.S. Pat. No. 3,876,391 McCoy teaches fuel micro-emulsions (having water droplets smaller than 0.1 microns diameter) using significantly more emulsifying agents and less mechanical agitation.

Prior art water levels of 10,000 to 400,000 parts per million ("ppm") in the fuel is generally accepted as necessary to achieve any worthwhile improvement in combustion. Typical of all this group of patents is U.S. Pat. No. 4,744,796 Hazbun.

US patent application # 20030226312 (Roos, et al) paragraph [0040] discloses the possibility of using engine oil (emulsions) to carry water soluble metallic compounds used to improve the efficiency of engine exhaust after-treatment devices. However, Roos does not disclose how any oil emulsions might be produced, nor do they claim any engine combustion benefits, neither do they cite any examples using this method.

U.S. Pat. No. 5,540,788 (Defalco and McCoy) and U.S. Pat. No. 5,310,419 (McCoy and Defalco) discloses using engine lubricating oil as a phosphate bath for water soluble compounds employed to form an iron-phosphate conversion coating surface in internal combustion engines. However, the disclosed additives contain phosphoric acid, an alkali metal hydroxide, a source of reactive NH2 groups and employ no surfactants. They are therefore clearly distinguishable from the present invention.

SUMMARY OF THE INVENTION

Objects and Advantages

Crankcase lubricating oils intended for use in internal combustion machines are dosed at 20:1 to 2,000:1 with a micro-emulsion forming additive. The resulting lubricating oil composition has the object of improving engine fuel efficiency to such an extent that the invention can be employed in a significantly cost effective manner not previously realized by any prior art lubricating oil emulsion.

Another object of the invention is to increase engine power.

A further object is to reduce engine exhaust emissions.

Still further objects and advantages will become apparent from consideration of the following description and examples.

DETAILED DESCRIPTION OF THE INVENTION

Additive compositions are disclosed which can be mixed with engine crankcase lubricating oils to form stable "water-in-oil" micro-emulsions.

Improved combustion and fuel efficiency can be achieved by dosing the additive into lubricating oils using a dose ratio of from about 20:1 up to about 2,000:1 (preferably from about 100:1 up to about 400:1).

All internal combustion machines inevitably burn a small amount of lubricating oil during combustion. Typically, the quantity of lubricating oil consumed would be very small; about 1 pint per 3,000 miles traveled (or about 100 ml per 1,000 km). It has never before been realized that such a small amount of lubricating oil could still carry sufficient quantities of a water micro-emulsion to be able to affect engine combustion characteristics in any significant manner.

There are two primary ways for this oil to find its way into the engine combustion chamber. The first way is from the cylinder walls past the piston rings. The second way is down the intake valve stem (where it is picked up by the incoming gasoline/air mixture and thereby carried into the engine combustion chamber).

The additives are produced by mixing together appropriate proportions of surfactant(s), co-surfactant(s) and water. Hydrocarbon solvents can also be included.

Generally, a minimum number of at least two surfactants would be required, each one acting against the other in order to achieve exactly the right HLB balance for the specific fuel to be treated. For a good explanation of this required surfactant HLB balance refer to U.S. Pat. No. 3,876,391 McCoy.

When the additive is mixed with engine crankcase lubricating oils a multitude of dispersed micro-emulsified water droplets are created, each droplet having an initial diameter from about 1.0 to 100 nanometers (0.001 to 0.1 microns), typically 3.0 to 9.0 nanometers. These dispersed micro-emulsified water droplets remain in stable suspension until such time as they are carried into the combustion chamber with the oil.

Additives of the present invention can be produced which are stable enough for most commercial applications. These severe "real world" applications require emulsion stability from below −40 deg C. to over +80 deg C., not only as an additive but also after dosing into the oil.

TABLE 1

(Commercially Available Surfactants Used to Produce the Additives):

| Trade Name | Chemical Name | Type | Supplier |
|---|---|---|---|
| Arquad T-50 | Trimethyl Tallow Alkyl Quat | Cationic | Akzo Nobel |
| Aristonate "M" | Sodium Alkyl Aryl Sulfonate | Anionic | Pilot |
| Aristonate "L" | Sodium Alkyl Aryl Sulfonate | Anionic | Pilot |
| Chembetaine CAS | Cocoamidopropyl Hydroxysultaine | Amphoteric | Chemron |
| Hamposyl C-30 | Sodium Cocyl Sarcosinate | Anionic | Hampshire |
| Makon 4 | Ethoxylated Alkylphenol | Non-ionic | Stepan |

TABLE 1-continued (Commercially Available Surfactants Used to Produce the Additives):

| Trade Name | Chemical Name | Type | Supplier |
|---|---|---|---|
| Makon 8 | Ethoxylated Alkylphenol | Non-ionic | Stepan |
| Norfox TLS | Triethanolamine Lauryl Sulfate | Anionic | Norman Fox |
| Ninate 411 | Amine Alkylbenzene Sulfonate | Anionic | Stepan |
| Span 80 | Sorbitan Monooleate | Non-ionic | ICI |
| Surfonic L24-4 | Linear Alcohol Ethoxylate | Non-ionic | Huntsman |
| Surfonic L24-9 | Linear Alcohol Ethoxylate | Non-ionic | Huntsman |
| Ninate 411 | Amine Alklybenzene Sulphonate | Non-ionic | Stepan |
| Tween 80 | POE (20) Sorbitan Monooleate | Non-ionic | ICI |
| Pamak W4 | Tall Oil Fatty Acid | Non-ionic | Hercules |
| Norfox IM 38 | Oleyl Imidazoline Hydrochloride | Cationic | Norman Fox |
| Norfox F-221 | Oleamide Diethanolamine | Non-ionic | Norman Fox |

Comments on Co-Surfactants Used in the Additives

All co-surfactants used to produce the additives should be well recognized by those skilled in the art and are readily available from many industrial sources. For this reason, trade names and suppliers have been omitted for these components.

Although specific alcohols have been named as being suitable co-surfactants, other low molecular weight alcohols (either alone or in combination) could also be used.

Although specific glycols have been named as being suitable co-surfactants, other low molecular weight glycols (either alone or in combination) could also be used.

Also, certain glycol ethers have been employed in combination with low molecular weight alcohols to form strong coupling agents well known to those skilled in the art. Specifically, these glycol ethers can be obtained from Dow Chemical under the trade names Dowanol DPM (dipropylene glycol methyl ether) and Dowanol EB (ethylene glycol n-butyl ether). Although these two glycol ethers have been specifically named as being suitable co-surfactants, other glycol ethers might also be suitable.

Comments on Hydrocarbon Solvents Used in the Additives

Although kerosene was used as the hydrocarbon (HC) solvent when making certain of the additives, those skilled in the art will realize that other hydrocarbon solvents (including oxygenated hydrocarbons) could easily be used instead of kerosene. Specifically, aliphatic, aromatic or paraffinic hydrocarbons (either alone or in combination) could also be used.

Producing the Additives (Examples #1 to #20)

When mixing together the surfactant(s), co-surfactant(s), water and hydrocarbon (HC) solvent to produce the micro-emulsion forming additives used in these examples, the following technique was used:

1) For those additives containing a hydrocarbon solvent, this was the first ingredient.

2) Alternatively, the co-surfactant(s) was either the next or the first ingredient.

3) Then the surfactant(s) was added using gentle stirring.

4) Finally, the water was added slowly with gentle stirring until the resulting additive was clear and stable. Regular city water (not distilled water) was used in all examples.

5) All ratios, ppm's and percentages used herein and elsewhere are by weight.

Examples of the Invention (Additives #1 to #12)

All additives disclosed in the following examples (#1 to #12) deliberately use various combinations of already existing and commercially available surfactants and co-surfactants. This has been done to clearly demonstrate that these additives should not be limited to any particular combination of specific surfactant(s) and co-surfactant(s). Each of the examples (#1 to #12) employs a high surfactant to water ratio (up to 8:1) necessary for long term emulsion stability.

There must be many such additives possible (using different combinations of other surfactants and co-surfactants) that could also be used to produce similar micro-emulsion forming additives. Reference is made specifically to (U.S. Pat. No. 4,744,796 Hazbun) which clearly demonstrates that various (equally effective) micro-emulsion fuels can be produced using diversely different types of surfactant and co-surfactant combinations. These other combinations might be better (or worse) than the specific examples which follow. Some may of other particular benefits depending on the balance of importance prevailing at the time.

Therefore, it is not critical which specific surfactant or co-surfactant combinations are used, provided that they are adequate. Different combinations may be better than others in some way or another, but it is essentially the use of a cost effective micro-emulsion forming additive (employing a high surfactant to water ratio) which is crucial to the practical application of the present invention.

TABLE 2

(Component Percentage Composition for Additive Examples #1 to #12):

| | #1 | #2 | #3 | #4 | #5 | #6 | #7 | #8 | #9 | #10 | #11 | #12 |
|---|---|---|---|---|---|---|---|---|---|---|---|---|
| HC Solvent (Kerosene) | — | — | — | — | — | — | 20 | 30 | — | 20 | 20 | — |
| Arquat T-50 | — | — | — | — | — | — | — | — | — | — | — | 20 |
| Aristonate "M" | — | 35 | — | — | — | — | — | — | — | — | — | — |
| Aristonate "L" | — | 25 | — | — | — | — | — | — | — | — | — | — |
| Chembetaine CAS | — | — | — | — | — | — | — | — | — | — | 10 | — |
| Hamposyl C-30 | — | — | — | — | 4 | — | — | — | — | — | — | — |
| Makon 4 | — | — | — | — | — | 20 | — | 20 | — | 30 | — | — |
| Makon 8 | — | — | — | 25 | — | 10 | — | 10 | — | 30 | — | — |
| Norfox TLS | — | — | — | — | — | — | 7 | — | — | — | — | — |
| Ninate 411 | 70 | — | — | — | — | 30 | — | 30 | 30 | — | 60 | — |
| Span 80 | — | — | — | 55 | 66 | — | 53 | — | 50 | — | — | 50 |
| Surfonic L24-4 | — | — | 40 | — | — | — | — | — | — | — | — | — |
| Surfonic L24-9 | — | — | 40 | — | — | — | — | — | — | — | — | — |
| Methanol | — | — | 10 | — | — | — | — | — | 5 | — | — | — |
| Ethanol | — | — | — | 10 | 10 | — | — | — | — | — | — | — |

TABLE 2-continued (Component Percentage Composition for Additive Examples #1 to #12):

| | #1 | #2 | #3 | #4 | #5 | #6 | #7 | #8 | #9 | #10 | #11 | #12 |
|---|---|---|---|---|---|---|---|---|---|---|---|---|
| Iso-Propanol | 20 | — | — | — | — | 20 | 10 | — | — | — | — | 20 |
| 2-Butanol | — | 20 | — | — | 10 | — | — | — | — | — | — | — |
| Ethylene Glycol | — | — | — | — | — | — | — | — | — | 10 | — | — |
| Propylene Glycol | — | — | — | — | — | — | — | — | 5 | — | — | — |
| Water | 10 | 20 | 10 | 10 | 10 | 20 | 10 | 10 | 10 | 10 | 10 | 10 |
| Total (%) | 100 | 100 | 100 | 100 | 100 | 100 | 100 | 100 | 100 | 100 | 100 | 100 |

TABLE 3

(Analysis of Component Percentage for Additive Examples #1 to #12):

| | #1 | #2 | #3 | #4 | #5 | #6 | #7 | #8 | #9 | #10 | #11 | #12 |
|---|---|---|---|---|---|---|---|---|---|---|---|---|
| HC Solvent (Kerosene) | — | — | — | — | — | — | 20 | 30 | — | 20 | 20 | — |
| Surfactant(s) | 70 | 60 | 80 | 80 | 70 | 60 | 60 | 60 | 80 | 60 | 70 | 70 |
| Co-surfactant(s) | 20 | 20 | 10 | 10 | 20 | 20 | 10 | 0 | 10 | 10 | 0 | 20 |
| Water | 10 | 20 | 10 | 10 | 10 | 20 | 10 | 10 | 10 | 10 | 10 | 10 |
| Total (%) | 100 | 100 | 100 | 100 | 100 | 100 | 100 | 100 | 100 | 100 | 100 | 100 |

Further Examples of the Invention (Additives #13 to #20)

In previous examples #1 to #12 only one or two surfactant(s) have been used in combination, consequently forming relatively "crude" additives. Those skilled in the art of surfactant chemistry should easily be able to improve the efficiency of the surfactant(s) and co-surfactant(s) combination. These more "sophisticated" additives would require less surfactant per unit of water and hence significantly improve the overall cost effectiveness of the additive.

Examples #1 to #12 require surfactant to water ratios of typically 7:1 in order to produce sufficiently stable emulsions. However, when using these more "sophisticated" surfactant packages, this ratio could be reduced to 3:1 or less (sometimes much less).

Therefore, examples #13 to #20 which follow are used to clearly demonstrate how these more "sophisticated" chemical packages can significantly reduce the total quantities of surfactants required, and hence improve the cost effectiveness of the additive, while still remaining sufficiently stable for most commercial applications.

TABLE 4

(Component Percentage Composition for Additive Examples #13 to #20):

| | #13 | #14 | #15 | #16 | #17 | #18 | #19 | #20 |
|---|---|---|---|---|---|---|---|---|
| Hydrocarbon Solvent (Kerosene) | — | — | — | 16.7 | — | — | — | — |
| Amine alkylbenzene sulphonate | 21.3 | 21.3 | 21.3 | 26.7 | 21.2 | 21.4 | 27.4 | 22.2 |
| POE (20) sorbitan monoleate | 10.4 | 10.4 | 10.4 | 3.3 | 7.7 | 12.9 | 16.5 | 2.2 |
| Tall oil fatty acids | 9.2 | 9.2 | 9.2 | 6.6 | 15.3 | 5.3 | 6.8 | — |
| Oleyl imidazoline hydrochloride | 4.8 | 4.8 | 4.8 | — | — | 6.4 | 8.2 | — |
| Oleamide diethanolamine | 8.0 | 8.0 | 8.0 | 13.3 | 7.7 | 10.7 | 13.6 | 4.5 |
| Methanol | 18.0 | 18.0 | 18.0 | — | — | 16.1 | 20.6 | — |
| Iso-propanol | — | — | — | 16.7 | 14.3 | — | — | — |
| N-butanol | — | — | — | — | — | — | — | 11.6 |
| Ethylene glycol n-butyl ether | 3.2 | 3.2 | 3.2 | — | — | 4.3 | 5.5 | — |
| Dipropylene glycol methyl ether | 0.7 | 0.7 | 0.7 | — | — | 1.1 | 1.4 | 2.3 |
| Water | 24.4 | 24.4 | 24.4 | 16.7 | 33.8 | 21.8 | 00.0 | 57.2 |
| Total (%) | 100 | 100 | 100 | 100 | 100 | 100 | 100 | 100 |

TABLE 5

(Analysis of Component Percentages for Additive Examples #13 to #20):

| | #13 | #14 | #15 | #16 | #17 | #18 | #19 | #20 |
|---|---|---|---|---|---|---|---|---|
| Hydrocarbon Solvent | 0 | 0 | 0 | 16.7 | 0 | 0 | 0 | 0 |
| Surfactant(s) | 53.7 | 53.7 | 53.7 | 49.9 | 51.9 | 56.7 | 72.5 | 28.9 |
| Co-surfactant(s) | 21.9 | 21.9 | 21.9 | 16.7 | 14.3 | 21.5 | 27.5 | 13.9 |
| Water | 24.4 | 24.4 | 24.4 | 16.7 | 33.8 | 21.8 | 00.0 | 57.2 |
| Total (%) | 100 | 100 | 100 | 100 | 100 | 100 | 100 | 100 |

TABLE 6

(Component Ratios and Percentages for Additive Examples #1 to #20):

| Liquid | Ratio (Preferred) | Ratio (Range) |
|---|---|---|
| Surfactant(s) | 3.0 to 1.5 | 8.0 to 0.5 |
| Co-surfactant(s) | 1.0 to 0.4 | 2.0 to 0.0 |
| Water ( =1.0) | 1.0 | 1.0 |
| **Liquid** | **% (Preferred)** | **% (Range)** |
| Surfactant(s) | 49.9 to 72.5 | 28.9 to 80.0 |
| Co-surfactant(s) | 13.9 to 21.9 | 0.0 to 27.5 |
| Water | 16.7 to 33.8 | 10.0 to 57.2 |

TABLE 7

(Additive ppm's in Oil for Examples #1 to #20):

| Liquid | ppm in oil (Preferred) | ppm in oil (Range) |
|---|---|---|
| Surfactant(s) | 1,250 to 7,250 | 145 to 40,000 |
| Co-surfactant(s) | 350 to 2,200 | 0 to 13,750 |
| Water | 420 to 1,380 | 50 to 28,600 |

Vehicle Test Results

No laboratory engine testing was carried out. Actual vehicles were used in "over the road" testing. Five completely different test vehicles were used. Three were gasoline powered and two were diesel powered. Two were from the USA, one was from Europe, and two were from Japan. Ages, mileages and emission control technologies were also widely different.

Oil Additive Vehicle Test #1

The engine oil was changed and baseline fuel economy and exhaust emissions were recorded for a 1990 Lexus LS400 test vehicle fitted with a fuel injected, turbocharged, 4.0 liter, V8 gasoline engine (odometer reading about 350,000 miles) using the manufacturer's recommended 92 octane fuel (R+M)/2 California reformulated gasoline.

Concentrated micro-emulsion oil additive #13 was then added to the engine oil used in this vehicle at a dose ratio of 200:1 (25 ml per 5 liters) and the vehicle was driven for 2 weeks using a typical daily commuter driving pattern. During this time, the driver reported a noticeable increase in engine power.

This same Lexus LS400 vehicle (which normally required the use of 92 octane fuels) could then use regular 87 octane fuels with no noticeable loss of power, knocking, pinging, or driveability problems.

Mileage testing on this same vehicle showed about a 10% improvement (from 19.0 mpg to 20.9 mpg), even when using the 87 octane fuel instead of 92 octane fuel.

Before and after exhaust emissions were also compared for this vehicle using the California Smog Check protocol (average of 6 tests). Average hydrocarbon (HC) emissions reduced from 20 ppm down to 4 ppm (an 80% reduction).

Oil Additive Vehicle Test #2

The engine oil was changed and baseline fuel economy and exhaust emissions were recorded for a 1972 Mercedes Benz, 220D automobile, fitted with a 4 cylinder diesel engine (2.2 liter, indirect injection, naturally aspirated). Odometer reading was about 220,000 miles. Fuel used was California #2D, low sulfur, low aromatic diesel fuel.

Concentrated micro-emulsion oil additive #13 was then added to the engine oil used in this vehicle at a dose ratio of 200:1 (25 ml per 5 liters) and the vehicle was driven for 2 weeks using a typical daily commuter driving pattern. During this time, the driver reported a noticeable increase in engine power.

The exhaust smoke level was measured by the "snap-idle" test using a N.T.K. model ST-100 diesel emission smoke tester (manufactured by Komyo Rikagku Kogyo K.K. of Japan). Opacity levels reduced from 14.8% down to 12.6%, or about a 15% reduction (average of 6 tests).

Mileage testing on this same vehicle showed about a 6% improvement (from 34.0 mpg to 36.0 mpg) when using #13 oil additive.

Oil Additive Vehicle Test #3

The engine oil was changed and baseline fuel economy and exhaust emissions were recorded for a 2001 Nissan Frontier XE (2×4) pick-up truck test vehicle, fitted with a naturally aspirated, fuel injected, 3.3 liter, V6 gasoline engine (odometer reading about 54,000 miles) using the manufacturer's recommended 87 octane fuel (R+M)/2 California reformulated gasoline.

Concentrated micro-emulsion oil additive #13 was then added to the engine oil used in this vehicle at a dose ratio of 100:1 (40 ml per 4 liters) and the vehicle was driven for 2 weeks using a typical daily commuter driving pattern. During this time, the driver reported a noticeable increase in engine power.

Mileage testing on this same vehicle showed about a 10% improvement (from 21.0 mpg to 23.3 mpg).

Before and after exhaust emissions were also compared for this vehicle using the California Smog Check protocol (average of 6 tests). Average hydrocarbon (HC) emissions reduced from 20 ppm down to 4 ppm (an 80% reduction).

Oil Additive Vehicle Test #4

The engine oil was changed and baseline fuel economy and exhaust emissions were recorded for a 1999 Ford F250 (4×4) pick-up truck, fitted with a V8 diesel engine (7.3 liter, direct injection, turbocharged and intercooled). Odometer reading was about 103,000 miles. Fuel used was California #2D, low sulfur, low aromatic diesel fuel.

Concentrated micro-emulsion oil additive #13 was then added to the engine oil used in this vehicle at a dose ratio of 200:1 (75 ml per 15 liters) and the vehicle was driven for 2 weeks using a typical daily commuter driving pattern. During this time, the driver reported a noticeable increase in engine power.

The exhaust smoke level was measured by the "snap-idle" test using a N.T.K. model ST-100 diesel emission smoke tester (manufactured by Komyo Rikagku Kogyo K.K. of Japan). Opacity levels reduced from 14.8% down to 12.6%, or about a 15% reduction (average of 6 tests).

Mileage testing on this same vehicle showed about a 6% improvement (from 16.6 mpg up to 17.6 mpg) when using #13 oil additive.

Oil Additive Vehicle Test #5

The engine oil was changed and baseline fuel economy and exhaust emissions were recorded for a 1997 Jeep Wrangler (4×4) SUV test vehicle, fitted with a naturally aspirated, fuel injected, 4.0 liter, in-line 6 cylinder gasoline engine (odometer reading about 90,000 miles) using the manufacturer's recommended 87 octane fuel (R+M)/2 California reformulated gasoline.

Concentrated micro-emulsion oil additive #13 was then added to the engine oil used in this vehicle at a dose ratio of 400:1 (12.5 ml per 5 liters) and the vehicle was driven for 2 weeks using a typical daily commuter driving pattern. During this time, the driver reported a noticeable increase in engine power.

Mileage testing on this same vehicle showed about a 10% improvement (from 16.8 mpg to 18.5 mpg).

Before and after exhaust emissions were also compared for this vehicle using the California Smog Check protocol (average of 6 tests). Average hydrocarbon (HC) emissions reduced from 20 ppm down to 4 ppm (an 80% reduction).

Oil Additive Vehicle Test #6

The same vehicle used for test #1 (the 1990 Lexus LS400), was also used for test #6. Immediately after the completion of test #1, the treated oil was drained and the engine refilled with fresh oil (this time containing no oil additive). However, it is impossible to fully drain 100% of the oil from the engine in the 1 or 2 minutes taken for a typical oil change. Consequently, about 10% of the original oil (treated with the oil additive) still remained in the engine.

This therefore gave a resulting dose ratio of about 2,000:1 for the oil additive in the fresh oil (or about 2.5 ml per 5 liters).

The vehicle was then driven for 2 weeks using a typical daily commuter driving pattern. During this time, the driver reported almost the same increase over baseline engine power achieved with the 200:1 oil additive dose.

This same Lexus LS400 vehicle (which normally required the use of 92 octane fuels) could use 89 octane fuels with no noticeable loss of power, knocking, pinging, or driveability problems.

Mileage testing on this same vehicle showed about a 5% improvement (from 19.0 mpg to 20.0 mpg), even when using the 89 octane fuel instead of 92 octane fuel.

Before and after exhaust emissions were also compared for this vehicle using the California Smog Check protocol (average of 6 tests). Average hydrocarbon (HC) emissions reduced from 20 ppm down to 10 ppm (a 50% reduction).

Oil Additive Vehicle Test #7

The same vehicle used for test #6 (the 1990 Lexus LS400), was also used for test #7. Immediately after the completion of test #6, the oil was drained and concentrated micro-emulsion oil additive #13 was added to the fresh engine oil used in this vehicle at a dose ratio of 20:1 (250 ml per 5 liters) and the vehicle was driven for another 2 weeks using the same typical daily commuter driving pattern. During this time, the driver reported slightly more increase in engine power than was achieved with test #1.

This same Lexus LS400 vehicle (which normally required the use of 92 octane fuels) could still use regular 87 octane fuels with no noticeable loss of power, knocking, pinging, or driveability problems.

Mileage testing on this same vehicle showed about the same 10% improvement (from 19.0 mpg to 20.9 mpg) achieved in test #1, even when using the 87 octane fuel instead of 92 octane fuels.

Before and after exhaust emissions were also compared for this vehicle using the California Smog Check protocol (average of 6 tests). Again, average hydrocarbon (HC) emissions reduced from 20 ppm down to about 4 ppm (an 80% reduction).

Comments on Oil Additive Testing (Examples #1 to #7)

From the above vehicle tests it would appear that an oil additive dose ratio of between about 20:1 and about 2,000:1 (preferably within the range of about 100:1 to about 400:1) could be used. At above about 20:1 the cost/benefit ratio becomes unattractive. At below about 2,000:1 the additive performance begins to deteriorate.

It is obvious from the above test results that using the oil additives of the present invention significantly improves vehicle power, fuel economy and exhaust emissions. This is an unusual, surprising and unexpected result, considering the extremely small quantities of oil additive actually making their way into the engine combustion chamber during each individual combustion cycle.

SUMMARY OF THE INVENTION

This invention relates to a micro-emulsion oil additive composition which reduces the exhaust emissions and improves the fuel economy of internal combustion machines in a significantly cost effective manner not realized by any prior art emulsion.

The oil additive composition is intended to be used at a dose level ratio of from about 20:1 to about 2,000:1 (preferably about 100:1 to about 400:1) in engine crankcase lubricating oils used in internal combustion machines.

The additive should comprise, in admixture form: from about 10% to 57.2% (preferably 16.7% to 33.8%) of water; from about 28.9% to 80% (preferably 49.9% to 72.5%) of surfactant selected from the group consisting of non-ionic, anionic, cationic and amphoteric surfactants and combinations thereof (preferably a combination of amine alkylbenzene sulphonate, POE [20] sorbitan monooleate, tall oil fatty acids, oleyl imidazoline hydrochloride and oleamide diethanolamine); from about 0% to 27.5% (preferably 13.9% to 21.9%) of co-surfactant selected from the group consisting of low molecular weight alcohols, low molecular weight glycols and glycol ethers combinations thereof (preferably methanol, ethanol, propanol, butanol, ethylene glycol, propylene glycol, ethylene glycol n-butyl ether and dipropylene glycol methyl ether and combinations thereof); and from about 0 to about 30% (preferably 0%) of hydrocarbon solvent (preferably kerosene).

When the additive is used in engine crankcase lubricating oil at a dose ratio from about 20:1 to about 2,000:1 (preferably 100:1 to about 400:1), this results in a micro-emulsion oil composition comprising: from about 950,000 to 999,500 ppm (preferably 990,00 to 997,500 ppm) of lubricating oil; from about 145 to 40,000 ppm (preferably 1,250 to 7,250 ppm) of surfactant selected from the group consisting of non-ionic, anionic, cationic and amphoteric surfactants and combinations thereof (preferably a combination of amine alkylbenzene sulphonate, POE [20] sorbitan monooleate, tall oil. fatty acids, oleyl imidazoline hydrochloride and oleamide diethanolamine); from about 0 to 13,750 ppm (preferably 350 to 2,200 ppm) of co-surfactant selected from the group consisting of low molecular weight alcohols, low molecular weight glycols and glycol ethers and combinations thereof (preferably methanol, ethanol, propanol, butanol, ethylene glycol, propylene glycol, ethylene glycol n-butyl ether and dipropylene glycol methyl ether and combinations thereof); from about 0 to 15,000 ppm (preferably 0 ppm) of hydrocarbon solvent (preferably kerosene); and from about 50 to 28,600 ppm (preferably 420 to 1,380 ppm) of added water, such that the ratio of surfactant to added water falls within the range from about 8:1 to about 0.5:1 (preferably about 3:1 to 1.5:1).

SCOPE OF THE INVENTION

It is to be understood that the reactants and components referred to by chemical name anywhere in the specification or claims hereof, whether referred to in the singular or plural, are identified as they exist prior to coming into contact with other substances referred to by chemical name or chemical type.

It does not matter what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure.

Thus the reactants and components are identified as ingredients to be brought together either in performing a desired chemical reaction (such as the formation of a surfactant compound) or in forming a desired composition (such as a fuel/oil additive concentrate or additized fuel/lubricating oil).

It will also be recognized that the additive components can be added or blended into or with the fuel/lubricating oils individually per se and/or as components used in forming preformed additive combinations and/or sub-combinations.

Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure.

The fact that the substance, components or ingredient may have lost its original identity through a chemical reaction or transformation during the course of such blending or mixing operations is thus wholly immaterial for an accurate understanding and appreciation of this disclosure and the claims thereof.

While only a few embodiments of the invention have been shown and described herein, it will become apparent to those skilled in the art that various modifications and changes can be made in the present invention to the present fuel/oil additive compositions to produce fuel/oil additive micro-emulsions without departing from the spirit and scope of the present invention. All such modifications and changes coming within the scope of the appended claims are intended to be carried out thereby.

We claim:

1. A method to improve the fuel economy of internal combustion machines comprising:

1. producing an oil additive composition, comprising in admixture form:
   a) a surfactant selected from the group consisting of non-ionic, anionic, cationic, amphoteric and mixtures thereof;
   b) optionally, a co-surfactant selected from the group consisting of methanol, ethanol, propanol, butanol, ethylene glycol, propylene glycol, ethylene glycol n-butyl ether, dipropylene glycol methyl ether and mixtures thereof;
   c) optionally, kerosene; and
   d) water,
2. providing a crankcase oil of lubricating viscosity,
3. producing a crankcase lubricating oil composition by dosing said crankcase oil of lubricating viscosity with from about 20:1 to about 2,000:1 by weight of said oil additive such that said crankcase lubricating oil composition comprises:
   a) from about 145 to about 40,000 ppm by weight of said surfactant;
   b) from about 0 to about 13,750 ppm by weight of said co-surfactant;
   c) from about 0 to about 15,000 ppm by weight of said kerosene; and
   d) from about 50 to about 28,600 ppm by weight of said water, such that the weight ratio of said surfactant to said water is from about 8:1 to about 0.5:1, and
4. operating said internal combustion machines using said crankcase lubricating oil composition.

2. A method to reduce the exhaust emissions from internal combustion machines, comprising:

1. producing an oil additive composition, comprising in admixture form:
   a) a surfactant selected from the group consisting of non-ionic, anionic, cationic, amphoteric and mixtures thereof;
   b) optionally, a co-surfactant selected from the group consisting of methanol, ethanol, propanol, butanol, ethylene glycol, propylene glycol, ethylene glycol n-butyl ether, dipropylene glycol methyl ether and mixtures thereof;
   c) optionally, kerosene; and
   d) water,
2. providing a crankcase oil of lubricating viscosity,
3. producing a crankcase lubricating oil composition by dosing said crankcase oil of lubricating viscosity with from about 20:1 to about 2,000:1 by weight of said oil additive such that said crankcase lubricating oil composition comprises:
   a) from about 145 to about 40,000 ppm by weight of said surfactant;
   b) from about 0 to about 13,750 ppm by weight of said co-surfactant;
   c) from about 0 to about 15,000 ppm by weight of said kerosene; and
   d) from about 50 to about 28,600 ppm by weight of said water, such that the weight ratio of said surfactant to said water is from about 8:1 to about 0.5:1, and
4. operating said internal combustion machines using said crankcase lubricating oil composition.

* * * * *